US006572203B1

(12) United States Patent
Cheng

(10) Patent No.: US 6,572,203 B1
(45) Date of Patent: Jun. 3, 2003

(54) CABINET DRAWER LOCKING DEVICE

(75) Inventor: Chen Kung Cheng, Taichung Hsien (TW)

(73) Assignee: E-Make Co., Ltd., Taichung Hsien (TW)

( * ) Notice: Subject to any disclaimer, the term of this patent is extended or adjusted under 35 U.S.C. 154(b) by 0 days.

(21) Appl. No.: 10/196,372

(22) Filed: Jul. 17, 2002

(51) Int. Cl.[7] ..... E05B 65/46
(52) U.S. Cl. ..... 312/217; 312/218; 292/DIG. 18
(58) Field of Search ..... 312/215, 216, 312/217, 218, 221, 222, 219; 292/DIG. 18; 70/78, 79, 80, 81

(56) References Cited

U.S. PATENT DOCUMENTS

| | | | | | |
|---|---|---|---|---|---|
| 1,552,511 | A | * | 9/1925 | Secoy | 312/221 |
| 2,719,770 | A | * | 10/1955 | Roberts | 312/221 |
| 5,605,388 | A | * | 2/1997 | Laakso | 312/218 |
| 5,862,689 | A | * | 1/1999 | Wen | 70/85 |
| 6,347,848 | B1 | * | 2/2002 | Cho | 312/219 |

FOREIGN PATENT DOCUMENTS

| | | | | |
|---|---|---|---|---|
| DE | 3431386 | A1 * | 3/1986 | A47B/67/00 |
| DE | 3732737 | A1 * | 12/1988 | A47B/55/00 |

* cited by examiner

*Primary Examiner*—Korie Chan
(74) *Attorney, Agent, or Firm*—Troxell Law Office PLLC

(57) ABSTRACT

A cabinet drawer locking device including a cabinet body, at least one drawer disposed in the cabinet body, a slide seat arranged on the cabinet body, an engaging body slidably disposed on the slides seat, a latch plate mounted on the drawer and a damper unit. The engaging body is formed with an engaging hole corresponding to the latch plate. The damper unit includes a shifting section, a forcing section, a first slide section and a second slide section. The forcing section serves to drive the shifting section. The first slide section is disposed on the shifting section and the second slide section is disposed on the engaging body corresponding to the first slide section. The first and second slide sections are relatively movably connected with each other, whereby the shifting section can drive the engaging body to slide between the first and second positions. When the engaging body is positioned in the second position, the stop section can push the engaging body to the first position and pass through the engaging hole and then the engaging body will naturally drop down to the second position.

10 Claims, 4 Drawing Sheets

CABINET DRAWER LOCKING DEVICE

BACKGROUND OF THE INVENTION

The present invention is related to a cabinet drawer locking device.

A conventional file or tool cabinet is a substantially rectangular case body with six faces. The case body is formed by several panels defining a space therebetween. Several drawers are horizontally disposed in the space layer by layer for placing documents or tools therein. In order to prevent the documents or tools from being stolen or prevent the drawers from dropping out due to shock or inclination of the ground, the file or tool cabinet is equipped with a locking device for locking the drawers.

In order to lock the respective drawers at one time, a conventional device or such as U. S. Pat. No. 4,966,422 disclose a locking device including an up and down movable latch body disposed on the panels of the case body. Each drawer has a hook section corresponding to a latch hole or a latch section of the latch body. The latch body is drivingly connected with a link. One end of the link extends out of the case body to connect with a rotary mechanism such as a key unit. By means of turning the rotary mechanism, the link is driven to drive the latch body to reciprocally move. Accordingly, the hook section can be latched with the latch hole or latch section to lock the respective drawers at one time.

When locking the drawers, the drawers must be totally pushed into the case body so as to locate the hook section at a position where the hook section is latched with the latch hole or latch section. However, it often takes place that after locking the drawers, a user finds that one or some of the drawers are not totally pushed in and are not locked. Under such circumstance, the user must unlock the drawers and then totally push in the drawers and then again lock the drawers. This makes it inconvenient and troublesome to perform the locking operation for the drawers.

The above shortcomings have been overcome by U.S. Pat. No. 6,347,848B1. This Patent includes a latch body upper end of which is formed with a slot having a predetermined length, a link having a bending section and a latch plate disposed on the drawer and having an inclined stop section. In the case that the latch body is positioned in a locking position for locking the drawers, while some drawers are not totally pushed in and locked, a user only needs to further force and push in the drawers. At this time, the latch body will ascend and then fall down to lock all the drawers. However, the above Patent has complicated structure. In addition, it is troublesome to assemble the link with the latch body and it is relatively laborious to drive the latch body.

SUMMARY OF THE INVENTION

It is therefore a primary object of the present invention to provide a cabinet drawer locking device including simpler components which can be more easily assembled. In the case that the locking device is positioned in the locking position, while some drawers are not totally pushed in and locked, a user only needs to further force and push in the drawers to conveniently lock all the drawers.

According to the above object, the cabinet drawer locking device of the present invention includes a cabinet body, at least one drawer disposed in the cabinet body, a slide seat arranged on the cabinet body, an engaging body slidably disposed on the slides seat, a latch plate mounted on the drawer and a damper unit. The engaging body is formed with an engaging hole corresponding to the latch plate. The damper unit includes a shifting section, a forcing section, a first slide section and a second slide section.

The present invention can be best understood through the following description and accompanying drawings wherein:

DETAILED DESCRIPTION OF THE PREFERRED EMBODIMENTS

Figure 1:
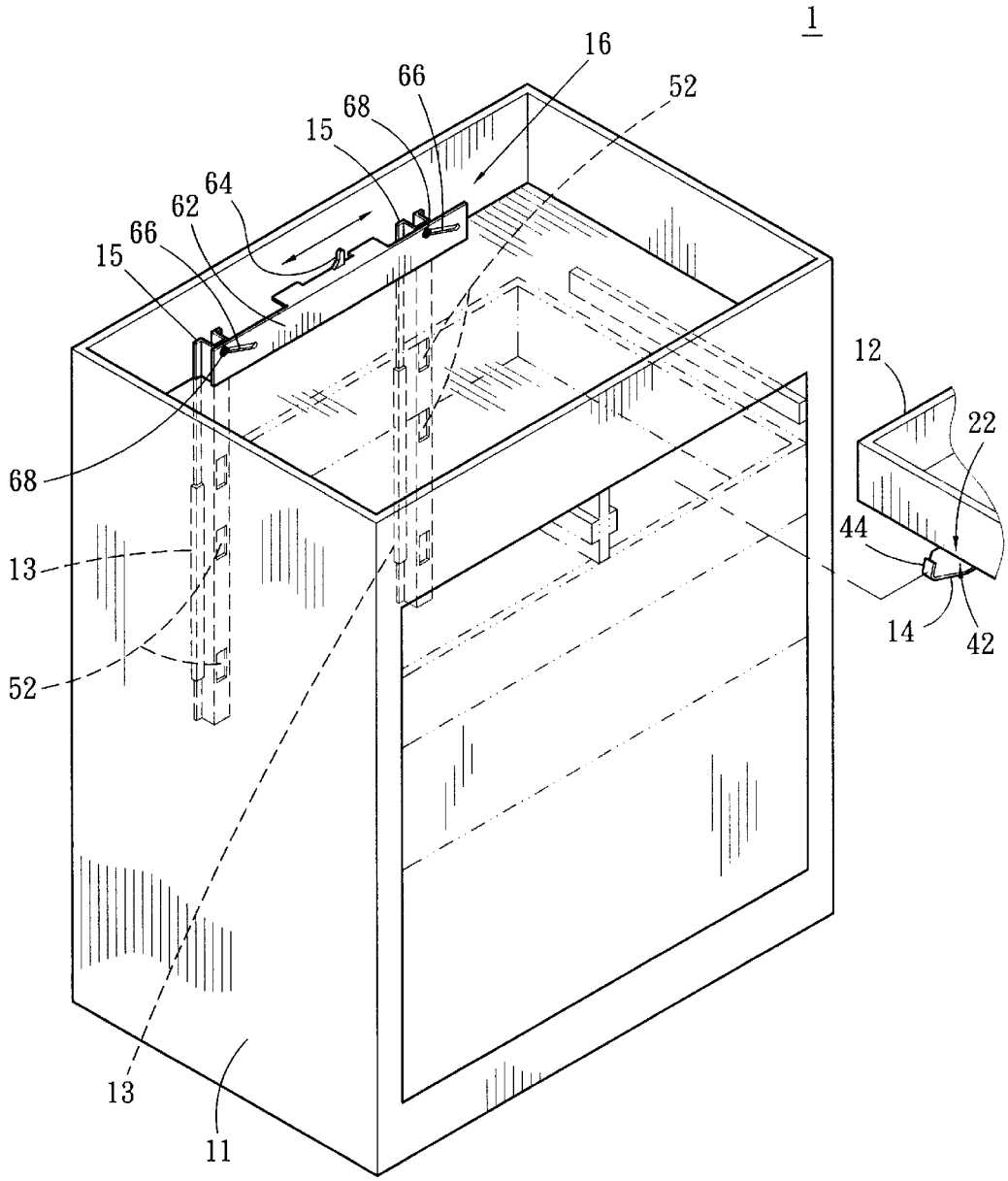
FIG. 1 is a perspective partially exploded view of a first embodiment of the present invention.
Figure 2:
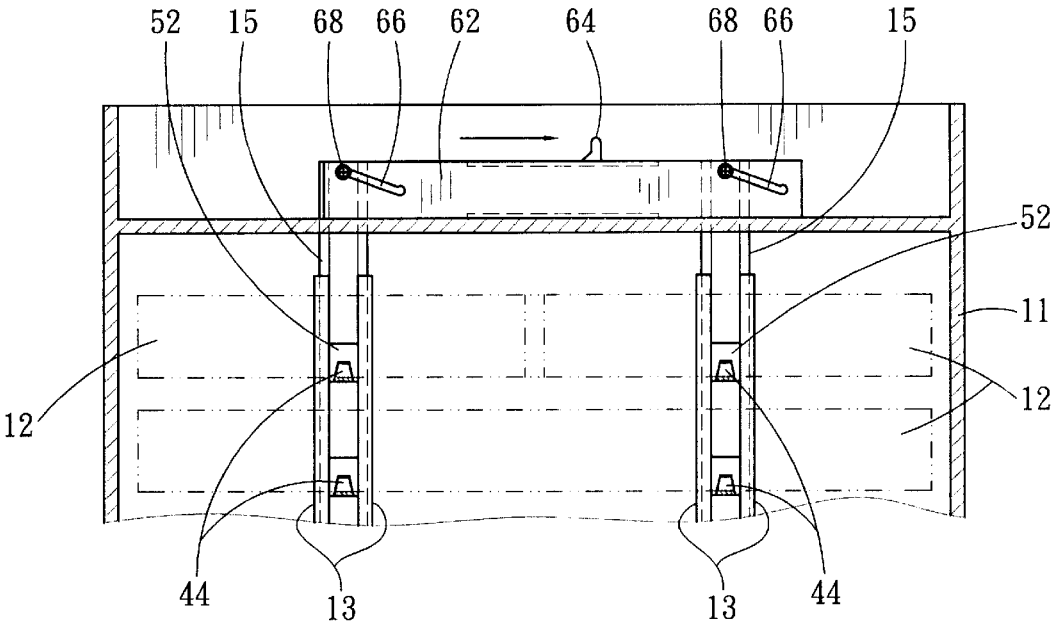
FIG. 2 is a sectional view showing that the first embodiment of the present invention is in an unlocking state (that is, the engaging body is positioned in the first position )
Figure 3:
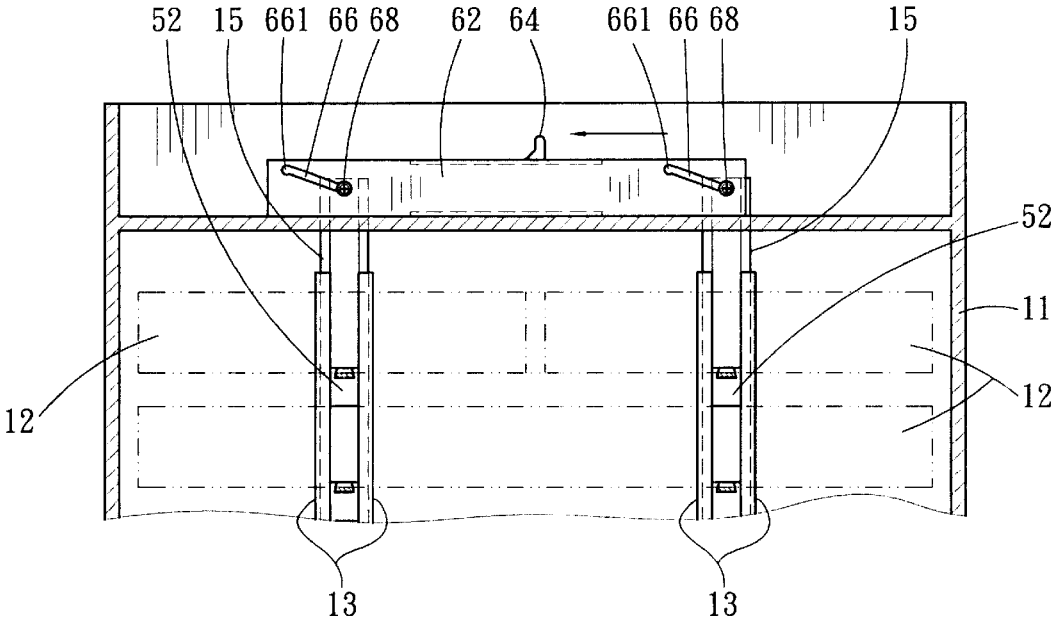
FIG. 3 is a sectional view showing that the first embodiment of the present invention is in a locking state ( that is, the engaging body is positioned in the second position )

Please refer to FIGS. 1 to 3. The cabinet drawer locking device 1 of the present invention includes a cabinet body 11, at least one drawer 12 disposed in the cabinet body 11, a slide seat 13 arranged on the cabinet body 11, a latch plate 14 mounted on the drawer 12, an engaging body 15 slidably disposed on the slides seat 13 and a damper unit 16.

The cabinet body 11 is a rectangular body composed of five rectangular panels defining an internal space and a vertical open side. The drawer 12 is back and forth slidably disposed on the open side. A predetermined section of rear side of the drawer 12 is provided with a drawer connecting section 22.

The slide seat 13 is fixedly disposed on a predetermined section of inner side of a panel of the cabinet body 11 corresponding to the rear side of the drawer 12.

The latch plate 14 has predetermined length and width. A predetermined section of one end of the latch plate 14 is formed with a latch plate connecting section 42 for fixedly connecting with the drawer connecting section 22. The other end thereof is bent toward the drawer 12 to form a stop section 44 having a predetermined length and inclination angle which is an acute angle.

The engaging body 15 is vertically slidably fitted in the slide seat 13. The engaging body 15 can slide in the lengthwise direction thereof between a first and a second positions.

The engaging body 15 is formed with an engaging hole 52 corresponding to the latch plate 14. When the engaging body 15 is positioned in the first position, the engaging hole 52 permits the latch plate 14 to freely get in and out in a direction perpendicular to the engaging body 15. When the engaging body 15 is positioned in the second position, the stop section 44 is extended through the engaging hole 52 and engaged therein.

The damper unit 16 includes a shifting section 62, a forcing section 64, a first slide section 66 and a second slide section 68.

The shifting section 62 is disposed on outer side of upper panel of the cabinet body 11. The first slide section 66 is disposed on the shifting section 62.

The forcing section 64 is disposed on a predetermined section of the shifting section 62 for driving the shifting section 62 to reciprocally move.

The second slide section 68 is disposed on the engaging body 15 corresponding to the first slide section 66. The first and second slide sections 66, 68 are relatively movably connected with each other. Accordingly, the shifting section 62 can drive the engaging body 15 to slide between the first and second positions. When the engaging body 15 is positioned in the second position, the stop section 44 can push the engaging body 15 to the first position and pass through the engaging hole 52. Then the engaging body 15 will restore to the second position. The first slide section 66 is a slot with an inclination angle. The second slide section 68 is a pin member fitted through the slot. One end of the pin member is disposed on the engaging body 15. An upper end of the slot bends and extends by a predetermined length to form a locating section 661 for truly locating the engaging body 15 in the first position.

According to the above arrangement, the cabinet drawer locking device 1 of the present invention has the following advantage:

By means of the inclined stop section 44 of the latch plate 14 and the relatively movable first and second slide sections 66, 68, in the case that the engaging body 15 is positioned in the locking position (second position), while some drawers 12 are not totally pushed in and locked, a user only needs to further force and push in the drawers. At this time, the engaging body 15 will ascend and then fall down to lock all the drawers.

Figure 4:
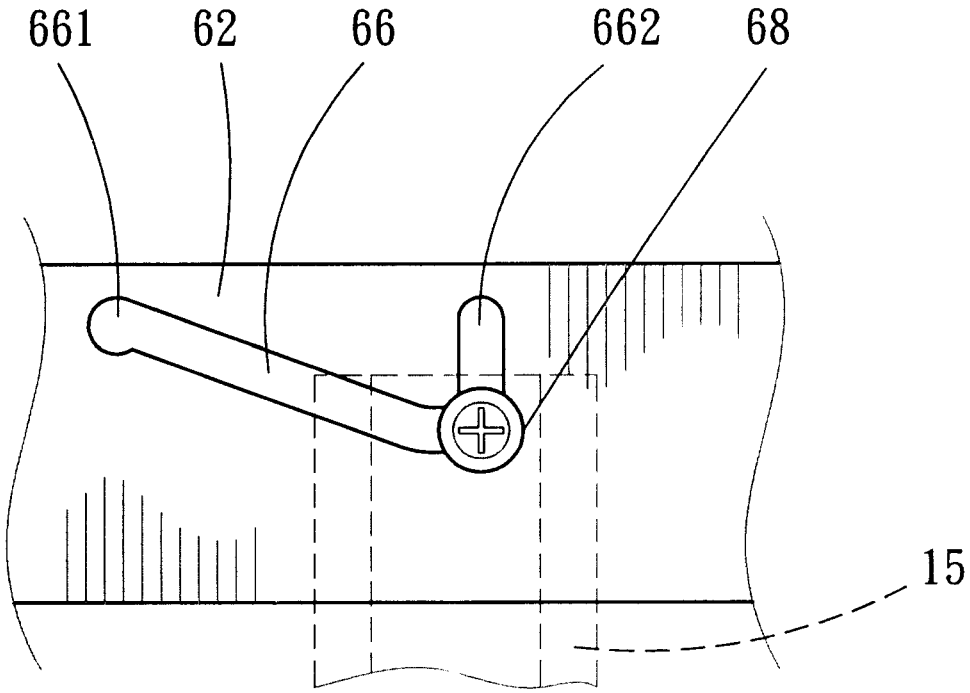
FIG. 4 shows another aspect of the first slide section of the first embodiment of the present invention.

Referring to FIG. 4, the lower end of the slot of the first slide section 66 further bends and extends by a predetermined length and then upward extends by a predetermined length to form a space 662. When the engaging body 15 is positioned in the second position and pushed upward, the shifting section 62 will not be driven and moved.

Figure 5:
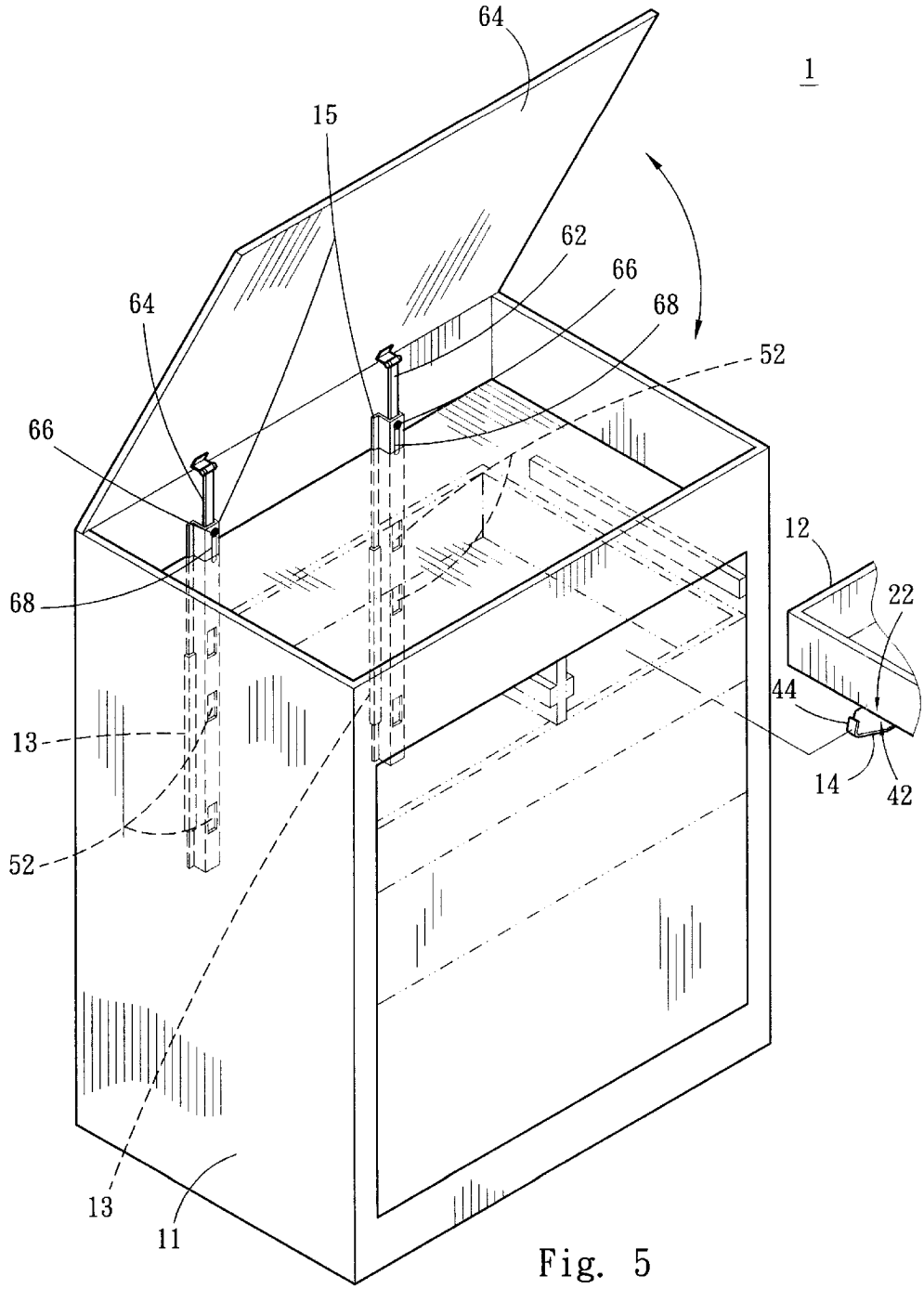
FIG. 5 is a perspective partially exploded view of a second embodiment of the present invention.

Referring to FIG. 5, the forcing section 64 of the cabinet drawer locking device 1 is a cover board.

One side of the cover board is pivotally connected with one side of the panel of the cabinet body 11 on which the slide seat 13 is mounted and positioned on upper side of the cabinet body 11.

The shifting section 62 is connected with the cover board. When the cover board is turned, the shifting section 62 is driven and moved.

The first slide section 66 is a pin member.

The second slide section 68 is a vertical slot having a predetermined length. The pin member is fitted through the slot. One end of the pin member is disposed on the shifting section 62.

Alternatively, according to the embodiment of FIG. 5, the first slide section 66 can be a vertical slot a having a predetermined length, while the second slide section 68 is a pin member. The pin member is fitted through the slot. One end of the pin member is disposed on the engaging body 15 to achieve the same object of the present invention The above embodiment are only used to illustrate the present invention, not intended to limit the scope thereof. Many modifications of the above embodiments can be made without departing from the spirit of the present invention.

What is claimed is:

1. A cabinet drawer locking device comprising:

a cabinet body which is a rectangular body composed of five rectangular panels defining an internal space and a vertical open side, at least one drawer being back and forth slidably disposed on the open side, a predetermined section of rear side of the drawer being provided with a drawer connecting section;

a slide seat fixedly disposed on a predetermined section of inner side of a panel of the cabinet body corresponding to the rear side of the drawer;

a latch plate having predetermined length and width, a predetermined section of one end of the latch plate being formed with a latch plate connecting section for fixedly connecting with the drawer connecting section, the other end thereof being bent toward the drawer to form a stop section having a predetermined length and inclination angle;

an engaging body vertically slidably fitted in the slide seat, whereby the engaging body can slide in the lengthwise direction thereof between a first and a second positions, the engaging body being formed with an engaging hole corresponding to the latch plate, whereby when the engaging body is positioned in the first position, the engaging hole permits the latch plate to freely get in and out in a direction perpendicular to the engaging body and when the engaging body is positioned in the second position, the stop section is extended through the engaging hole and engaged therein; and a damper unit including a shifting section, a forcing section, a first slide section and a second slide section, the shifting section being disposed on the cabinet body, the first slide section being disposed on the shifting section, the forcing section serving to drive the shifting section to reciprocally move, the second slide section being disposed on the engaging body corresponding to the first slide section, the first and second slide sections being relatively movably connected with each other, whereby the shifting section can drive the engaging body to slide between the first and second positions and when the engaging body is positioned in the second position, the stop section can push the engaging body to the first position and pass through the engaging hole and then the engaging body will restore to the second position.

2. A cabinet drawer locking device as claimed in claim 1, wherein the forcing section is disposed on a predetermined section of the shifting section.

3. A cabinet drawer locking device as claimed in claim 1, wherein the shifting section is disposed on outer side of upper panel of the cabinet body.

4. A cabinet drawer locking device as claimed in claim 1, wherein the first slide section is a slot having an inclination angle, upper end of the slot bending and extending by a predetermined length, the second slide section being a pin member fitted through the slot, one end of the pin member being disposed on the engaging body.

5. A cabinet drawer locking device as claimed in claim 1, wherein lower end of the slot further bends and extends by a predetermined length and then upward extends by a predetermined length.

6. A cabinet drawer locking device as claimed in claim 1, wherein the inclination angle of the stop section is an acute angle.

7. A cabinet drawer locking device as claimed in claim 1, wherein the forcing section is a cover board, one side of the cover board being pivotally connected with one side of the panel of the cabinet body on which the slide seat is mounted and being positioned on upper side of the cabinet body, the shifting section being connected with the cover board, whereby when the cover board is turned, the shifting section is driven and moved.

8. A cabinet drawer locking device as claimed in claim 7, wherein the shifting section is pivotally connected with the cover board.

9. A cabinet drawer locking device as claimed in claim 7, wherein the first slide section is a pin member and the second slide section is a vertical slot having a predetermined length, the pin member being fitted through the slot, one end of the pin member being disposed on the shifting section.

10. A cabinet drawer locking device as claimed in claim 7, wherein the first slide section is a vertical slot having a predetermined length and the second slide section is a pin member, the pin member being fitted through the slot, one end of the pin member being disposed on the engaging body.

* * * * *